US010249123B2

(12) United States Patent
Hatton

(10) Patent No.: US 10,249,123 B2
(45) Date of Patent: Apr. 2, 2019

(54) SYSTEMS AND METHODS FOR MOBILE PHONE KEY FOB MANAGEMENT

(71) Applicant: FORD GLOBAL TECHNOLOGIES, LLC, Dearborn, MI (US)

(72) Inventor: David Anthony Hatton, Berkley, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 358 days.

(21) Appl. No.: 14/682,293

(22) Filed: Apr. 9, 2015

(65) Prior Publication Data

US 2016/0300417 A1 Oct. 13, 2016

(51) Int. Cl.
*G07C 9/00* (2006.01)

(52) U.S. Cl.
CPC ..... *G07C 9/00857* (2013.01); *G07C 9/00309* (2013.01); *G07C 2009/00865* (2013.01)

(58) Field of Classification Search
None
See application file for complete search history.

(56) References Cited

U.S. PATENT DOCUMENTS

| | | | |
|---|---|---|---|
| 4,543,569 | A | 9/1985 | Karlstrom |
| 5,081,667 | A | 1/1992 | Drori et al. |
| 5,467,070 | A | 11/1995 | Drori et al. |
| 5,513,107 | A | 4/1996 | Gormley |
| 5,627,510 | A | 5/1997 | Yuan |
| 5,635,916 | A | 6/1997 | Bucholtz et al. |
| 5,655,081 | A | 8/1997 | Bonnell et al. |
| 5,734,336 | A | 3/1998 | Smithline |
| 5,776,031 | A | 7/1998 | Minowa et al. |
| 5,828,319 | A | 10/1998 | Tonkin et al. |
| 5,874,889 | A | 2/1999 | Higdon et al. |
| 5,959,540 | A | 9/1999 | Walter |

(Continued)

FOREIGN PATENT DOCUMENTS

| | | |
|---|---|---|
| CN | 101596895 | 12/2009 |
| DE | 102007046270 | 4/2009 |

(Continued)

OTHER PUBLICATIONS

Driver Focus-Telematics Working Group, Statement of Principles, Criteria and Verification Procedures on Driver Interactions with Advanced In-Vehicle Information and Communications Systems, Including 2006 Updated Sections, Jun. 26, 2006.

(Continued)

*Primary Examiner* — Daniell L Negron
(74) *Attorney, Agent, or Firm* — Frank Lollo; Brooks Kushman P.C.

(57) ABSTRACT

A vehicle system includes one or more vehicle processors programmed to: provide a user interface to program a first wireless device as a new vehicle key and to delete a second wireless device as an existing vehicle key. The one or more vehicle processors may be further programmed to wirelessly transmit vehicle key security codes from the vehicle to the first device to program the first device. The one or more vehicle processors may be further programmed to display one or more programmed devices including the second device via a user interface for user selection to delete the second device as an existing vehicle key.

20 Claims, 8 Drawing Sheets

(56) References Cited

U.S. PATENT DOCUMENTS 6,018,291 A 1/2000 Marble et al.
6,133,825 A 10/2000 Matsuoka
6,177,866 B1 1/2001 O'Connell
6,198,996 B1 3/2001 Berstis
6,263,282 B1 7/2001 Vallancourt
6,268,804 B1 7/2001 Janky et al.
6,271,745 B1 8/2001 Anzai et al.
6,282,226 B1 8/2001 Furukawa
6,434,455 B1 8/2002 Snow et al.
6,434,486 B1 8/2002 Studt et al.
6,438,491 B1 8/2002 Farmer
6,501,369 B1 * 12/2002 Treharne ..... B60R 25/24 307/10.5
6,539,078 B1 3/2003 Hunt et al.
6,574,734 B1 6/2003 Colson et al.
6,590,495 B1 7/2003 Behbehani
6,668,221 B2 12/2003 Harter, Jr. et al.
6,679,702 B1 1/2004 Rau
6,690,260 B1 2/2004 Ashihara
6,737,963 B2 5/2004 Gutta et al.
6,754,562 B2 6/2004 Strege et al.
6,785,542 B1 8/2004 Blight et al.
6,810,309 B2 10/2004 Sadler et al.
6,853,919 B2 2/2005 Kellum
6,859,718 B2 2/2005 Fritz et al.
6,871,145 B2 3/2005 Altan et al.
6,906,619 B2 6/2005 Williams et al.
6,941,194 B1 9/2005 Dauner et al.
7,057,501 B1 6/2006 Davis
7,075,409 B2 7/2006 Guba
7,102,496 B1 9/2006 Ernst, Jr. et al.
7,124,027 B1 10/2006 Ernst, Jr. et al.
7,148,790 B2 12/2006 Aoyama et al.
7,161,563 B2 1/2007 Vitale et al.
7,173,903 B2 2/2007 Remboski et al.
7,194,069 B1 3/2007 Jones et al.
7,207,041 B2 4/2007 Elson et al.
7,228,213 B2 6/2007 Sakai et al.
7,246,062 B2 7/2007 Knott et al.
7,266,438 B2 9/2007 Kellum et al.
7,337,113 B2 2/2008 Nakagawa et al.
7,340,332 B2 3/2008 Underdahl et al.
7,356,394 B2 4/2008 Burgess
7,366,892 B2 4/2008 Spaur et al.
7,375,620 B2 5/2008 Balbale et al.
7,391,305 B2 6/2008 Knoll et al.
7,484,008 B1 1/2009 Gelvin et al.
7,565,230 B2 7/2009 Gardner et al.
7,602,782 B2 10/2009 Doviak et al.
7,783,475 B2 8/2010 Neuberger et al.
7,812,712 B2 10/2010 White et al.
7,826,945 B2 11/2010 Zhang et al.
8,050,817 B2 11/2011 Moinzadeh
8,050,863 B2 11/2011 Trepagnier et al.
8,089,339 B2 1/2012 Mikan et al.
8,232,864 B2 7/2012 Kakiwaki
8,237,554 B2 8/2012 Miller et al.
8,258,939 B2 9/2012 Miller et al.
8,265,022 B2 9/2012 Hans
8,301,108 B2 10/2012 Naboulsi
8,305,189 B2 11/2012 Miller et al.
8,311,722 B2 11/2012 Zhang et al.
8,335,502 B2 12/2012 Oesterling et al.
8,947,202 B2 2/2015 Tucker et al.
2001/0021891 A1 9/2001 Kusafuka et al.
2002/0013650 A1 1/2002 Kusafuka et al.
2002/0031228 A1 3/2002 Karkas et al.
2002/0096572 A1 7/2002 Chene et al.
2002/0097145 A1 7/2002 Tumey et al.
2003/0004730 A1 1/2003 Yuschik
2003/0055643 A1 3/2003 Wowstemeyer et al.
2003/0079123 A1 4/2003 Mas Ribes
2003/0217148 A1 11/2003 Mullen et al.
2003/0220725 A1 11/2003 Harter, Jr. et al.
2003/0231550 A1 12/2003 MacFarlane
2004/0046452 A1 3/2004 suyama et al.
2004/0073367 A1 4/2004 Altan et al.
2004/0088205 A1 5/2004 Geisler et al.
2004/0124968 A1 7/2004 Inada et al.
2004/0176906 A1 9/2004 Matsubara et al.
2004/0227642 A1 11/2004 Giles et al.
2004/0236475 A1 11/2004 Chowdhary
2005/0021597 A1 1/2005 Derasmo et al.
2005/0033517 A1 2/2005 Kondoh et al.
2005/0125110 A1 6/2005 Potter et al.
2005/0134115 A1 6/2005 Betts, Jr. et al.
2005/0177635 A1 8/2005 Schmidt et al.
2005/0190039 A1 9/2005 Aoyama et al.
2005/0193212 A1 9/2005 Yuhara
2005/0261816 A1 11/2005 Dicroce et al.
2006/0056663 A1 3/2006 Call
2006/0142917 A1 6/2006 Goudy
2006/0150197 A1 7/2006 Werner
2006/0156315 A1 7/2006 Wood et al.
2006/0220904 A1 10/2006 Jarlengrip
2006/0250224 A1 11/2006 Steffel et al.
2006/0293813 A1 12/2006 Nou
2007/0027595 A1 2/2007 Nou
2007/0050854 A1 3/2007 Cooperstein et al.
2007/0072616 A1 3/2007 Irani
2007/0100514 A1 5/2007 Park
2007/0103339 A1 5/2007 Maxwell et al.
2007/0255568 A1 11/2007 Pennock
2008/0070616 A1 3/2008 Yun
2008/0109653 A1 5/2008 Yokohama
2008/0148374 A1 6/2008 Spaur et al.
2008/0150683 A1 6/2008 Mikan et al.
2008/0275604 A1 11/2008 Perry et al.
2009/0030605 A1 1/2009 Breed
2009/0045928 A1 2/2009 Rao et al.
2009/0096596 A1 4/2009 Sultan et al.
2009/0167524 A1 7/2009 Chesnutt et al.
2009/0184800 A1 7/2009 Harris
2009/0195370 A1 8/2009 Huffman et al.
2009/0275281 A1 11/2009 Rosen
2009/0309709 A1 12/2009 Bevacqua et al.
2010/0004818 A1 1/2010 Phelan
2010/0007479 A1 1/2010 Smith
2010/0013596 A1 1/2010 Kakiwaki
2010/0039224 A1 2/2010 Okude et al.
2010/0057586 A1 3/2010 Chow
2010/0075656 A1 3/2010 Howarter et al.
2010/0097178 A1 4/2010 Pisz et al.
2010/0148923 A1 6/2010 Takizawa
2010/0178872 A1 7/2010 Alrabady et al.
2010/0191535 A1 7/2010 Berry et al.
2010/0191973 A1 7/2010 Huntzicker et al.
2010/0222939 A1 * 9/2010 Namburu ..... G07C 9/00111 701/2
2010/0030458 A1 12/2010 Coughlin
2010/0321203 A1 12/2010 Tieman et al.
2011/0009107 A1 1/2011 Guba et al.
2011/0018793 A1 1/2011 Chene et al.
2011/0071720 A1 3/2011 Schondorf et al.
2011/0071725 A1 3/2011 Kleve et al.
2011/0071734 A1 3/2011 Van Wiemeersch et al.
2011/0102146 A1 5/2011 Giron
2011/0105097 A1 5/2011 Tadayon et al.
2011/0106374 A1 5/2011 Margot et al.
2011/0112969 A1 5/2011 Zaid et al.
2011/0148574 A1 6/2011 Simon et al.
2011/0166748 A1 7/2011 Schneider et al.
2011/0213629 A1 9/2011 Clark et al.
2011/0215921 A1 9/2011 Ayed et al.
2011/0275321 A1 11/2011 Zhou et al.
2011/0295444 A1 12/2011 Westra et al.
2012/0041633 A1 2/2012 Schunder et al.
2012/0054036 A1 3/2012 Nam et al.
2012/0071140 A1 3/2012 Oesterling et al.
2012/0115446 A1 5/2012 Gautama et al.
2012/0139760 A1 6/2012 Bevacqua et al.
2012/0157069 A1 6/2012 Elliott et al.
2012/0280786 A1 11/2012 Miller et al.
2012/0284702 A1 11/2012 Ganapathy et al.

(56) References Cited

U.S. PATENT DOCUMENTS

| | | | | |
|---|---|---|---|---|
| 2012/0293317 | A1 | 11/2012 | Hanna et al. | |
| 2012/0313768 | A1 | 12/2012 | Campbell et al. | |
| 2013/0005302 | A1 | 1/2013 | Ozaki | |
| 2013/0162421 | A1 | 6/2013 | Inaguma et al. | |
| 2013/0200999 | A1 | 8/2013 | Spodak et al. | |
| 2013/0204455 | A1 | 8/2013 | Chia et al. | |
| 2013/0259232 | A1 | 10/2013 | Petel | |
| 2013/0278381 | A1 | 10/2013 | Lopez et al. | |
| 2014/0040621 | A1 | 2/2014 | Klimke | |
| 2014/0066000 | A1 | 3/2014 | Butler | |
| 2014/0077972 | A1 | 3/2014 | Rathi et al. | |
| 2014/0176301 | A1 | 6/2014 | Banares et al. | |
| 2014/0277837 | A1* | 9/2014 | Hatton | B60R 25/24 701/2 |

FOREIGN PATENT DOCUMENTS

| | | |
|---|---|---|
| EP | 449471 | 10/1991 |
| EP | 971463 | 1/2000 |
| EP | 1095527 | 5/2001 |
| WO | 2001025572 | 4/2001 |
| WO | 2009158469 | 12/2009 |
| WO | 2012015403 | 2/2012 |

OTHER PUBLICATIONS

Ford Motor Company, "SYNC with Navigation System," Owners Guide Supplement, SYNC System Version 1 (Jul. 2007).

Ford Motor Company, "SYNC," Owner's Guide Supplement, SYNC System Version 1 (Nov. 2007).

Ford Motor Company, "SYNC with Navigation System," Owner's Guide Supplement, SYNC System Version 2 (Oct. 2008).

Ford Motor Company, "SYNC," Owners Guide Supplement, SYNC System Version 2 (Oct. 2008).

Ford Motor Company, "SYNC with Navigation System," Owners Guide Supplement, SYNC System Version 3 (Jul. 2009).

Ford Motor Company, "SYNC," Owner's Guide Supplement, SYNC System Version 3 (Aug. 2009).

Kermit Whitfield, "A hitchhiker's guide to the telematics ecosystem," Automotive Design & Production, Oct. 2003, << http://findarticles.com pp. 1-3 >>.

Autobiometrics, COM, US Distributor for ATRD Biometric Immobilizer, << http://www.autobiometrics.com >> Jul. 6, 2011.

Sales@usasupremetech.com, In the U.S. A Car is Stolen Every 26 Seconds, The Wave of the Future, Biometrics Authentication, An Introduction.

* cited by examiner

SYSTEMS AND METHODS FOR MOBILE PHONE KEY FOB MANAGEMENT

TECHNICAL FIELD

The present disclosure relates to an electronic key system and a vehicle computing system for managing a mobile device key fob.

BACKGROUND

A primary portable device to access a vehicle by transmitting an activation message including a vehicle access credential to the vehicle is known. The primary portable device can additionally enable a secondary portable device to access the vehicle by transmitting the vehicle access credential to the secondary portable device. The connections between the primary portable device, secondary portable device, and vehicle can be based on a short-range wireless protocol, such as Bluetooth or Bluetooth LE Likewise, an electronic key system may include a vehicle equipped with vehicle equipment, and a mobile phone having an electronic key function including ID information for the vehicle equipment. The vehicle equipment compares the ID information of the electronic key provided in the mobile phone with standard ID information of the vehicle equipment, makes the vehicle and/or the vehicle equipment perform a first operation when the ID information matches and a second operation when the ID information cannot be detected. The vehicle equipment transmits history information along with the first and second operations to the mobile phone.

A wireless device for providing secure operation of a vehicle may operate according to a method where a key for accessing a vehicle is detected, a vehicle operation policy associated with the key is retrieved, and operation of the vehicle consistent with the vehicle operation policy is permitted. The key may be embedded within a wireless device such as a cellular telephone. The vehicle operation policy may include an access control rule that may indicate to enable, partially enable, or disable a vehicle operation feature. Where the intended operation of the vehicle is not consistent with the access control rule, the operation may not be permitted and an enforcement action may be taken, such as disabling a feature of the vehicle.

A cell phone may be mated with the vehicle system and thereafter used to obtain access to the vehicle. A user who has a cell phone automatically can obtain access to the vehicle. A USB key may provide access to the vehicle, and in an emergency, either a complete or partial version of the key can be downloaded from a server. See, for example, U.S. Pat. Nos. 8,947,202; 8,232,864; 8,089,339; and U.S. Pat. App. US2009/0184800.

SUMMARY

A first illustrative embodiment includes a system having one or more vehicle processors programmed to provide a user interface to program a first wireless device as a new vehicle key and to delete a second wireless device as an existing vehicle key. The one or more vehicle processors are further programmed to wirelessly transmit vehicle key security codes from the vehicle to the first device to program the first device. The one or more vehicle processors may be further programmed to display one or more programmed devices including the second device for user selection for deletion or removal as the existing vehicle key.

A second illustrative embodiment includes a non-transitory computer readable medium comprising instructions configured to cause at least one processor coupled to a transceiver to receive a request via the transceiver for establishing communication between the at least one processor and a vehicle processor. The computer readable medium comprises further instructions to receive vehicle key security codes and predefined user identification from the vehicle processor based on the established communication. The at least one processor is configured to command one or more vehicle functions without the presence of a vehicle key fob based on the vehicle key security codes and the predefined user identification. The computer readable medium comprises further instructions to transmit the one or more vehicle functions to the vehicle processor based on the predefined user identification entered at a user interface.

A third illustrative embodiment includes a vehicle computing system having at least one processor in communication with a transceiver and a user interface to manage mobile key fob devices. The processor is programmed to execute a key fob program request received via the user interface. The at least one processor is further programmed to output one or more mobile devices detected by the transceiver based on the request. The at least one processor is further programmed to receive a selection of at least one of the detected mobile devices and transmit vehicle security codes and a predefined user identification via the transceiver to configure the selected mobile device as a key fob.

DETAILED DESCRIPTION

Figure 1A:
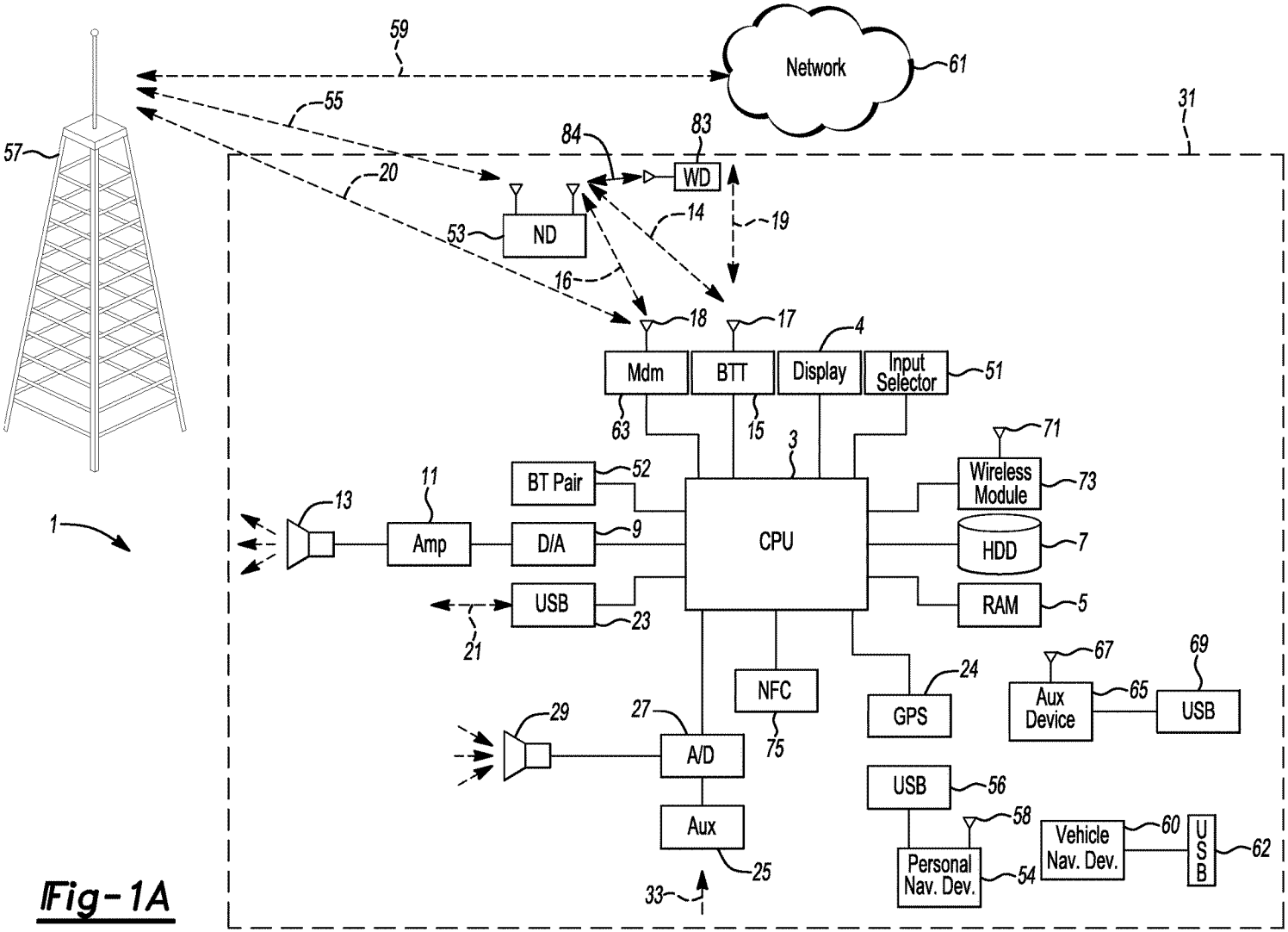
FIG. 1A is an exemplary block topology of a vehicle infotainment system implementing a user-interactive vehicle information display system.

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

The embodiments of the present disclosure generally provide for a plurality of circuits or other electrical devices. All references to the circuits and other electrical devices and the functionality provided by each, are not intended to be limited to encompassing only what is illustrated and described herein. While particular labels may be assigned to the various circuits or other electrical devices disclosed, such labels are not intended to limit the scope of operation for the circuits and the other electrical devices. Such circuits and other electrical devices may be combined with each other and/or separated in any manner based on the particular type of electrical implementation that is desired. It is recognized that any circuit or other electrical device disclosed herein may include any number of microprocessors, integrated circuits, memory devices (e.g., FLASH, random access memory (RAM), read only memory (ROM), electrically programmable read only memory (EPROM), electrically erasable programmable read only memory (EEPROM), or other suitable variants thereof) and software which co-act with one another to perform operation(s) disclosed herein. In addition, any one or more of the electric devices may be configured to execute a computer-program that is embodied in a non-transitory computer readable medium that is programmed to perform any number of the functions as disclosed.

The disclosure relates to systems and methods for managing the configuration of one or more mobile devices to be used as a vehicle key fob. A mobile device key fob management application and system may enable a vehicle computing system to configure, manage, and enable a mobile device to perform key fob functions at a vehicle without the presence of the key fob.

The systems and methods may program a mobile device as the key fob based on interaction with one or more components of the vehicle computing system. For example, the vehicle computing system may provide a user interface display to instruct a user to perform the steps of programming the mobile device as a key (e.g., key fob). The vehicle computing system may transmit key security codes to a mobile device in communication with the system via input at the user interface display.

The vehicle computing system may provide instructions to the user interface display for managing the removal of the one or more mobile devices having the key fob security codes. For example, the user interface display may present the one or more mobile devices having key fob security codes allowing control of one or more vehicle features/functions. The vehicle computing system may allow a user to delete a mobile device from having mobile device key fob access to the vehicle via the user interface display.

FIG. 1 illustrates an example block topology for a vehicle based computing system 1 (VCS) for a vehicle 31. An example of such a vehicle-based computing system 1 is the SYNC system manufactured by THE FORD MOTOR COMPANY. A vehicle enabled with a vehicle-based computing system may contain a visual front end interface 4 located in the vehicle. The user may also be able to interact with the interface if it is provided, for example, with a touch sensitive screen. In another illustrative embodiment, the interaction occurs through button presses, spoken dialog system with automatic speech recognition, and speech synthesis.

In the illustrative embodiment 1 shown in FIG. 1, a processor 3 controls at least some portion of the operation of the vehicle-based computing system. Provided within the vehicle, the processor allows onboard processing of commands and routines. Further, the processor is connected to both non-persistent 5 and persistent storage 7. In this illustrative embodiment, the non-persistent storage is random access memory (RAM) and the persistent storage is a hard disk drive (HDD) or flash memory. In general, persistent (non-transitory) memory can include all forms of memory that maintain data when a computer or other device is powered down. These include, but are not limited to, HDDs, CDs, DVDs, magnetic tapes, solid state drives, portable USB drives and any other suitable form of persistent memory.

The processor is also provided with a number of different inputs allowing the user to interface with the processor. In this illustrative embodiment, a microphone 29, an auxiliary input 25 (for input 33), a USB input 23, a GPS input 24, screen 4, which may be a touchscreen display, and a BLUETOOTH input 15 are all provided. An input selector 51 is also provided, to allow a user to swap between various inputs. Input to both the microphone and the auxiliary connector is converted from analog to digital by a converter 27 before being passed to the processor. Although not shown, numerous vehicle components and auxiliary components in communication with the VCS may use a vehicle network (such as, but not limited to, a CAN bus) to pass data to and from the VCS (or components thereof).

For example, a near field communication (NFC) transceiver 75 may be integrated with the VCS 1. The NFC transceiver 75 may communicate with the processor 3. The NFC transceiver 75, such as a Texas Instrument™ TRF7970A, may be configured to communicate with one or more mobile devices. The NFC transceiver 75 may include an RFID tag, a loop antenna, a flexible fabric packaging material and an EMI shielding material. The NFC transceiver 75 may be used to communicate and authentic a key fob. For example, the NFC transceiver 75 may communicate with a mobile device configured with NFC and having key fob vehicle security codes embedded within the mobile device computing system.

Outputs to the system can include, but are not limited to, a visual display 4 and a speaker 13 or stereo system output. The speaker is connected to an amplifier 11 and receives its signal from the processor 3 through a digital-to-analog converter 9. Output can also be made to a remote BLUETOOTH device such as PND 54 or a USB device such as vehicle navigation device 60 along the bi-directional data streams shown at 19 and 21, respectively.

In one illustrative embodiment, the system 1 uses the BLUETOOTH transceiver 15 to communicate 17 with a user's mobile device 53 (e.g., cell phone, smart phone, tablet, PDA, or any other device having wireless remote network connectivity). The mobile device (e.g., nomadic device) can then be used to communicate 59 with a network 61 outside the vehicle 31 through, for example, communication 55 with a cellular tower 57. In some embodiments, tower 57 may be a WiFi access point.

Exemplary communication between the mobile device and the BLUETOOTH transceiver is represented by signal 14.

Pairing a mobile device 53 and the BLUETOOTH transceiver 15 can be instructed through a button 52 or similar input. Accordingly, the CPU is instructed that the onboard BLUETOOTH transceiver will be paired with a BLUETOOTH transceiver in a mobile device.

In another example, the mobile device 53 and the NFC transceiver 75 may be configured to communicate with each other via one or more applications executed on hardware at the VCS 1. The processor 3 may instruct the NFC transceiver 75 to communicate with the mobile device 53. For example, the processor may transmit one or more messages to a mobile device 53 via the NFC transceiver 75. In another example, the processor 3 may receive one or more messages from the mobile device 53 via the NFC transceiver 75.

Data may be communicated between CPU 3 and network 61 utilizing, for example, a data plan, data over voice, or DTMF tones associated with nomadic device 53. Alternatively, it may be desirable to include an onboard modem 63 having antenna 18 in order to communicate 16 data between CPU 3 and network 61 over the voice band. The nomadic device 53 can then be used to communicate 59 with a network 61 outside the vehicle 31 through, for example, communication 55 with a cellular tower 57. In some embodiments, the modem 63 may establish communication 20 with the tower 57 for communicating with network 61. As a non-limiting example, modem 63 may be a USB cellular modem and communication 20 may be cellular communication.

In one illustrative embodiment, the processor is provided with an operating system including an API to communicate with modem application software. The modem application software may access an embedded module or firmware on the BLUETOOTH transceiver to complete wireless communication with a remote BLUETOOTH transceiver (such as that found in a mobile device). Bluetooth is a subset of the IEEE 802 PAN (personal area network) protocols. IEEE 802 LAN (local area network) protocols include WiFi and have considerable cross-functionality with IEEE 802 PAN. Both are suitable for wireless communication within a vehicle. Another communication device that can be used in this realm is free-space optical communication (such as IrDA) and non-standardized consumer IR protocols.

In another embodiment, mobile device 53 includes a modem for voice band or broadband data communication. In the data-over-voice embodiment, a technique known as frequency division multiplexing may be implemented when the owner of the mobile device can talk over the device while data is being transferred. At other times, when the owner is not using the device, the data transfer can use the whole bandwidth (300 Hz to 3.4 kHz in one example). While frequency division multiplexing may be common for analog cellular communication between the vehicle and the internet, and is still used, it has been largely replaced by hybrids of Code Domain Multiple Access (CDMA), Time Domain Multiple Access (TDMA), and Space-Domain Multiple Access (SDMA) for digital cellular communication. These are all ITU IMT-2000 (3G) compliant standards and offer data rates up to 2 mbs for stationary or walking users and 385 kbs for users in a moving vehicle. 3G standards are now being replaced by IMT-Advanced (4G) which offers 100 mbs for users in a vehicle and 1 gbs for stationary users. If the user has a data-plan associated with the nomadic device, it is possible that the data plan allows for broad-band transmission and the system could use a much wider bandwidth (speeding up data transfer). In still another embodiment, mobile device 53 is replaced with a cellular communication device (not shown) that is installed to vehicle 31. In yet another embodiment, the mobile device (e.g., the nomadic device illustrated as ND 53) may be a wireless local area network (LAN) device capable of communication over, for example (and without limitation), an 802.11g network (i.e., WiFi) or a WiMax network.

In one embodiment, incoming data can be passed through the mobile device via a data-over-voice or data-plan, through the onboard BLUETOOTH transceiver and into the vehicle's internal processor 3. In the case of certain temporary data, for example, the data can be stored on the HDD or other storage media 7 until such time as the data is no longer needed.

Additional sources that may interface with the vehicle include a personal navigation device 54, having, for example, a USB connection 56 and/or an antenna 58, a vehicle navigation device 60 having a USB 62 or other connection, an onboard GPS device 24, or remote navigation system (not shown) having connectivity to network 61. USB is one of a class of serial networking protocols. IEEE 1394 (FireWire™ (Apple), i.LINK™ (Sony), and Lynx™ (Texas Instruments)), EIA (Electronics Industry Association) serial protocols, IEEE 1284 (Centronics Port), S/PDIF (Sony/Philips Digital Interconnect Format) and USB-IF (USB Implementers Forum) form the backbone of the device-device serial standards. Most of the protocols can be implemented for either electrical or optical communication.

Further, the CPU could be in communication with a variety of other auxiliary devices 65. These devices can be connected through a wireless 67 or wired 69 connection. Auxiliary devices 65 may include, but are not limited to, personal media players, wireless health devices, portable computers, and the like.

Also, or alternatively, the CPU could be connected to a vehicle based wireless router 73, using for example a WiFi (IEEE 803.11) 71 transceiver. This could allow the CPU to connect to remote networks in range of the local router 73.

In addition to having exemplary processes executed by a vehicle computing system located in a vehicle, in certain embodiments, the exemplary processes may be executed by a computing system in communication with a vehicle computing system. Such a system may include, but is not limited to, a wireless mobile device (e.g., and without limitation, a mobile phone) or a remote computing system (e.g., and without limitation, a server) connected through the wireless device. Collectively, such systems may be referred to as vehicle associated computing systems (VACS). In certain embodiments, particular components of the VACS may perform particular portions of a process depending on the particular implementation of the system. By way of example and not limitation, if a process has a step of sending or receiving information with a paired wireless device, then it is likely that the wireless device is not performing the process, since the wireless device would not "send and receive" information with itself. One of ordinary skill in the art will understand when it is inappropriate to apply a particular VACS to a given solution. In all solutions, it is contemplated that at least the vehicle computing system (VCS) located within the vehicle itself is capable of performing the exemplary processes.

The embodiments of the present disclosure generally provide for the mobile device to be programmed to control functional operations as a key fob. In general, the vehicle computing system (VCS) 1 may be designed to allow for transmission of security codes using a secured method of wireless communication including, but not limited to, near field communication. The embodiments of the present disclosure provide a system and method allowing the VCS 1 the ability to transmit security codes to a mobile device, therefore using the mobile device in place of the key fob to communicate with the vehicle computing system.

The various operations that are capable of being controlled by the mobile device operating as a key may include, but are not limited to, entering the vehicle, exiting the vehicle, starting the vehicle, and/or opening the trunk. The embodiments of the present disclosure as set forth in FIGS. 1-6 generally illustrate and describe a plurality of controllers (or modules), or other such electrically based components. All references to the various controllers and electrically based components and the functionality provided for each, are not intended to be limited to encompassing only what is illustrated and described herein. While particular labels may be assigned to the various controllers and/or electrical components disclosed, such labels are not intended to limit the scope of operation for the controllers and/or the electrical components. The controllers (or modules) may be combined with each other and/or separated in any manner based on the particular type of electrical architecture that is desired or intended to be implemented in the vehicle and/or mobile device.

Figure 1B:
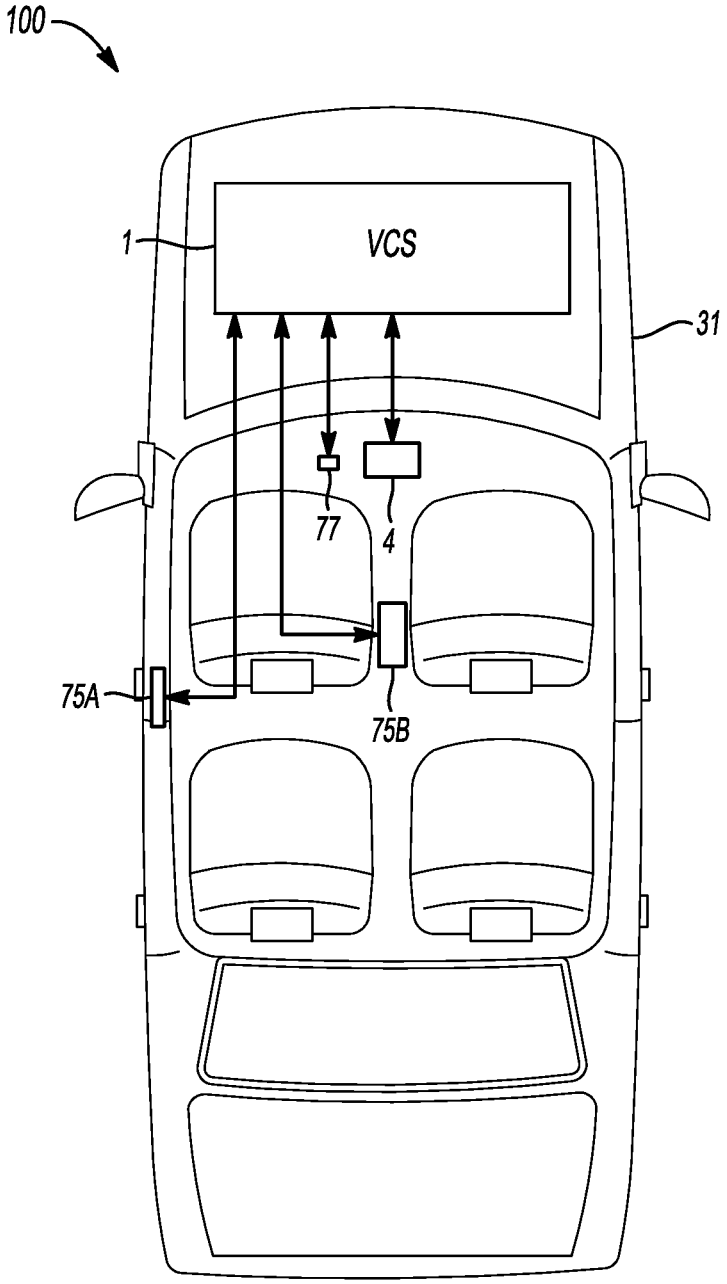
FIG. 1B is an illustrative embodiment of the vehicle infotainment system implementing a mobile device key fob management system.

FIG. 1B is an illustrative embodiment of the vehicle infotainment system implementing a mobile device key fob management system 100. The mobile device key fob management system 100 may be configured with, and executed on, one or more hardware components of the VCS 1. For example, the mobile device key fob management system 100 may have one or more applications executed at the processor 3, NFC transceiver 75A 75B, display 4, and/or a combination thereof.

The mobile device key fob management system 100 may have a key fob management application executed at the processor 3. For example, the system 100 may output the key fob management application at the user interface 4. The key fob management application may receive input requesting the configuration of one or more mobile devices to be used as a key fob for the vehicle 31. The key fob management application my output for display one or more instructions to configure the mobile device as the key fob.

For example, the key fob management application may output a message instructing a user to place the mobile device 53 at a certain location in the vehicle having an NFC transceiver 75B. In one embodiment, the NFC transceiver 75B may be a slot/pad (not shown) configured for the mobile device 53. In another embodiment, the slot may include a wired connection to communicate with the key fob management application via the VCS 1. In response to the key fob management system 100 recognizing the mobile device via the NFC transceiver 75B, the key fob management application may transmit vehicle security codes allowing the mobile device to be configured as the vehicle key fob. The key fob management application may output a message when the vehicle security code transfer is complete.

The mobile device 53 having the vehicle security codes may be configured as the vehicle key fob and may transmit one or more key fob messages to the VCS 1. For example, the mobile device 53 may unlock the vehicle using the NFC transceiver 75A configured at a vehicle door. The NFC transceiver 75A at the vehicle door may have power enabled at the transceiver during a vehicle off state (e.g., key-off, ignition off, etc.). The NFC transceiver 75A may execute an energize routine during the vehicle off state such that the energy is powered in predefined intervals.

The mobile device 53 may transmit a powertrain start request using the NFC transceiver 75B located in the vehicle cabin. The powertrain start request may require the mobile device 53 to be placed in close proximity to the NFC transceiver 75B and selection of an ignition start input 77 while the user pushes in the brake pedal (not shown). In one example, in response to the mobile device 53 tapping the NFC field 75A at the vehicle door, the system may begin a timer in which the powertrain start request allows the user to select an ignition start input 77 while depressing the brake pedal to enable the powertrain. If the timer expires, the system may require the user to reinitiate the timer by using the in-vehicle NFC field 75B. In another example, if the mobile key fob device is recognized by the system during the time period associated with the timer as being previously paired, the system may allow the powertrain to be enabled based on an ignition start input 77 received after the timer expires.

Figure 2A:
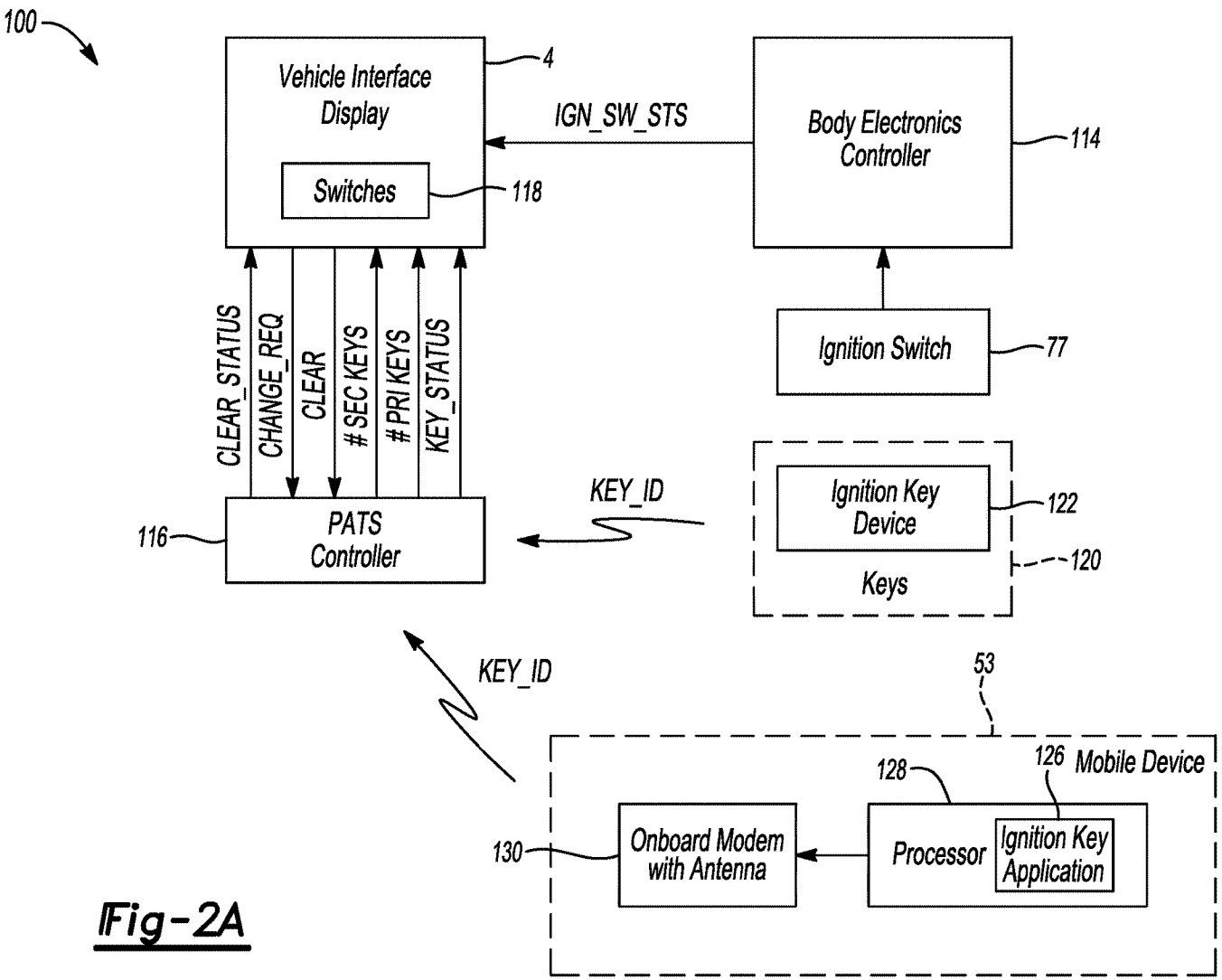
FIG. 2A depicts a system for programming a mobile device as a key fob for a vehicle in accordance with one embodiment of the present disclosure.

Referring now to FIG. 2A, the mobile device key fob system 100 in communication and/or embedded with the VCS 1 may program the mobile device 53 as a primary or secondary driver key fob for the vehicle 31 in accordance with one embodiment of the present disclosure. The system 100 includes the vehicle interface display 4, a body electronics controller 114, a passive anti-theft security (PATS) controller 116, one or more other modules in communication with the VCS, and/or a combination thereof. The vehicle interface display 4 may be implemented as a message center on an instrument cluster or as a touch screen monitor such that each device is generally configured to present text, menu options, status or other such inquiries to the driver in a visual format. A driver may scroll through the various fields of text and select menu options via at least one switch 118 positioned about the interface display 4. The switch 118 may be remotely positioned from the interface display 4 or positioned directly on the interface display 4. The vehicle interface display 4 may be any such device that is generally situated to provide information to, and receive feedback from, a vehicle occupant. The switches 118 may be in the form of voice commands, touch screen, and/or other such external devices (e.g., phones, computers, etc.) that are generally configured to communicate with the VCS 1 of the vehicle 31.

The interface display 4, the PATS controller 116, and the body electronics controller 114 may communicate with each other via a multiplexed data link communication bus (or multiplexed bus). The multiplexed bus may be implemented as a High/Medium Speed Controller Area Network (CAN) bus, a Local Interconnect Network (LIN), Ethernet, or any such suitable data link communication bus generally situated to facilitate data transfer between controllers (or modules) in the vehicle.

The body electronics controller 114 generally controls a portion or all of the electrical content in an interior section of the vehicle. In one example, the body electronics controller 114 may be a smart power distribution junction box (SPDJB) controller. The SPDJB controller may include a plurality of fuses, relays, and various micro-controllers for performing any number of functions related to the operation of interior and/or exterior electrically based vehicle functionality. Such functions may include but are not limited to electronic unlocking/locking (via interior door lock/unlock switches), remote keyless entry operation, vehicle lighting (interior and/or exterior), electronic power windows, and/or key ignition status (e.g., Off, Run, Start, Accessory (ACCY)).

An ignition switch 77 may be operably coupled to the body electronics controller 114. The body electronics controller 114 may receive hardwired signals indicative of the position of the ignition switch and transmit multiplexed messages on the multiplexed bus that are indicative of the position of the ignition switch. For example, the body electronics controller 114 may transmit a signal IGN_SW_STS (e.g., whether the ignition is in the OFF, Run, Start, or Accessory (ACCY) positions) over the multiplexed bus to the vehicle interface display 4. The signal IGN_SW_STS generally corresponds to the position of the ignition switch (e.g., Off, Run, Start, or Accessory positions).

The ignition switch 77 may receive and/or communicate with two or more keys 120 to start the vehicle. Each key 120 includes an ignition key device 122 embedded therein for communicating with the VCS 1. The ignition key device 122 comprises a transponder (not shown). The transponder includes an integrated circuit and an antenna. The transponder is adapted to transmit a signal KEY_ID in the form of a radio frequency (RF) signal to the PATS controller 116. The signal KEY_ID generally comprises RF data that corresponds to a manufacturer code, a corresponding key serial number and encrypted data. The key serial number and the encrypted data are used to authorize the engine controller to start the vehicle in the event the encrypted data corresponds to predetermined encrypted data stored in a look up table (LUT) of the PATS controller 116. The PATS controller 116 may use the key number and/or the encrypted data transmitted on the signal KEY_ID to determine if the key is a primary key or a secondary key. In general, the driver who holds the primary key is presumed to be a primary driver. The driver who holds the secondary key is presumed to be a secondary driver. The manufacturer code generally corresponds to the manufacturer of the vehicle. For example, the manufacturer code may correspond to Ford Motor Company. Such a code prevents the user (or technician) from mistakenly configuring a key with a manufacturer code of another vehicle manufacturer to a Ford vehicle. An example of a LUT that may be stored in the PATS controller 116 is shown in TABLE 1 directly below.

TABLE 1

| KEY SERIAL # | MFG. CODE | ENCRYPTED DATA | TYPE |
|---|---|---|---|
| 1xxA | Ford | #$#$#$#$#$#$#$# | Primary |
| 2xxB | Ford | #######$$$$$$$$ | Secondary |
| 3xxC | Ford | $#$#$#$#$#$#$#$ | Secondary |
| NnnN | Ford | $$$$$$$######## | Primary |

The LUT may include any number of keys. To start the vehicle, the PATS controller 116 decodes the key serial number, the manufacturing code, and corresponding encrypted data received on the signal KEY_ID and compares such data to the key serial number and the encrypted data in the LUT to determine whether such data match prior to starting the vehicle for anti-theft purposes. In the event the data match, the engine controller operably coupled to the PATS controller 116 allows the vehicle to start the powertrain system (e.g., engine or electric motor).

In another embodiment, a mobile device 53 may be configured using a software application to communicate with the VCS 1 and/or PATS controller 116. The mobile device 53 may include, but is not limited to, cellular phone, tablet, and/or personal computer. The VCS 1 and/or PATS controller 116 may recognize the mobile device 53 as an authorized key fob via an NFC signal having vehicle security codes including a manufacturer code, a corresponding key serial number, encrypted data, and/or a combination thereof. In another embodiment, a paired mobile device via Bluetooth wireless communication may be recognized by the VCS 1 as an authorized key fob via the vehicle security codes. The VCS 1 may recognize the mobile device 53 as either a primary key or secondary key based on the vehicle security codes. The mobile device 53 may be recognized by the VCS 1 as a primary or secondary key using a software application communicating with the VCS 1 and/PATS controller 116. The mobile device 53 may include a transceiver to transmit a signal to the VCS 1 and/or PATS controller 116 using wireless communication including, but not limited to, Bluetooth technology, WiFi, NFC, and/or cellular communication. An example of an LUT that may be stored in the PATS controller 116 is shown in TABLE 2 directly below.

TABLE 2

| KEY SERIAL # | MFG. CODE | ENCRYPTED DATA | PAIRED MOBILE DEVICE TYPE |
|---|---|---|---|
| 1xxA | Ford | #$#$#$#$#$#$#$# | Primary |
| 2xxB | Ford | #######$$$$$$$$ | Secondary |
| 3xxC | Ford | $#$#$#$#$#$#$#$ | Secondary |
| NnnN | Ford | $$$$$$$######## | Primary |

For example, once the vehicle security code signals have been transmitted by the mobile device 53 via the NFC transceiver 75A, the PATS controller 116 and/or VCS 1 may recognize the mobile device 53. The mobile device 53 may include a software application 126 running in a processor 128 on the device to transmit a vehicle control signal using an onboard modem with antenna 128 to communicate with the VCS 1 of the vehicle 31 via the NFC transceiver 75. The PATS controller 116 and/or VCS 1 may recognize the mobile device 53 associated with a user using one or more of the key serial numbers, and/or manufacturing codes in combination with the mobile-device-transmitted encrypted data. The PATS controller 116 and/or VCS 1 may recognize the mobile device 53 from the received KEY_ID signal using one or more wireless communication technologies including, but not limited to, Bluetooth, WiFi, cellular, and/or NFC.

In another alternative example, the mobile device 124 may transmit the KEY_ID signal directly to the PATS controller 116 using an ignition key application 124 transmitting a short range wireless communication (e.g., radio frequency identification). For example, the hardwired signal indicative of a door handle being pulled may initiate the VCS to begin searching for the mobile device 53. The mobile device 53 may communicate with the VCS 1 using the ignition key application allowing the VCS 1 to recognize if the mobile device 53 has been paired. The VCS 1 may determine if the mobile device is authorized based on the encrypted data received from the mobile device 53, and/or the VCS previous configuration of the paired mobile device 53. The VCS may further determine if the mobile device is authorized to control one or more functions of the VCS 1 and/or if the mobile device is assigned a primary or secondary key designation.

To determine driver status, the PATS controller 116 decodes the key number and/or the encrypted data received on the signal KEY_ID and reads the corresponding key status (e.g., primary or secondary) next to the key number and/or the encrypted data as shown in the heading 'TYPE' of Table 1, and respectively Table 2, to determine whether the key and/or mobile device 53 is the primary key or the secondary key. The PATS controller 116 transmits a signal KEY_STATUS to the vehicle interface display 4 to indicate whether the key is a primary key or a secondary key. The PATS controller 116 and/or the vehicle interface display 4 may transmit the signal KEY_STATUS to any controller or module in the electrical system such that the functionality or operation performed by a particular controller (or module) may be selectively controlled based on the key status (and/or the driver status).

The LUT in the PATS controller 116 assigns all of the keys and/or the associated mobile device 53 as primary keys by default when the vehicle is manufactured. The PATS controller 116 may update the key status for a key number in response to the driver changing the key status for a particular key via operations performed between the primary driver and the vehicle interface display 4 and/or configuring the software application 126 on the mobile device 124. In another exemplary embodiment, the vehicle interface display 4 updates and changes may be communicated to the mobile device 53 software application 126 using the communication established between the mobile device 53 and VCS 1.

The primary driver may optionally clear all keys that were designated as secondary keys via the vehicle interface display 4 and/or using the mobile device application. In such a case, the primary driver may select the corresponding menus via the vehicle interface display 4 and/or on the mobile device using the mobile application to clear all mobile key fobs that were programmed to the VCS 1. The vehicle interface display 4 transmits a signal CLEAR to control the PATS controller 116 to clear the selected one or more mobile key fobs or change the secondary keys to primary keys. The PATS controller 116 may transmit a signal CLEAR_STATUS to the vehicle interface display 4 to notify the vehicle interface display 4 that the mobile devices programmed to communicate as a key fob with the VCS 1 have been cleared and/or that the mobile key fobs programmed as secondary keys have been changed to primary keys. The PATS controller 116 transmits signals #PRIKEYS and #SECKEYS to the interface display 4 which are indicative of the number of primary keys in the LUT and the number of secondary keys in the LUT, respectively. The PATS controller 116 transmits the signals #PRIKEYS and #SECKEYS in response to control signals (not shown) by the vehicle interface display 4. It is generally contemplated that the signals KEY_STATUS, #PRIKEYS, and #SECKEYS (as well as the signal CLEAR_STATUS) may be sent as one or more messages over the multiplexed bus to the vehicle interface display 4. For example, the data on the signals KEY_STATUS, #PRIKEYS, #SECKEYS, CLEAR_STATUS may be transmitted as hexadecimal based data within a single message over the multiplexed data bus. Likewise, the vehicle interface display 4 may transmit the data on the signals CHANGE_REQ and CLEAR as hexadecimal based data within a single message over the multiplexed data bus. The PATS controller 116 may be integrated within the vehicle interface display 4 or be implemented as a standalone component or as controller embedded within another controller in the vehicle.

Figure 2B:
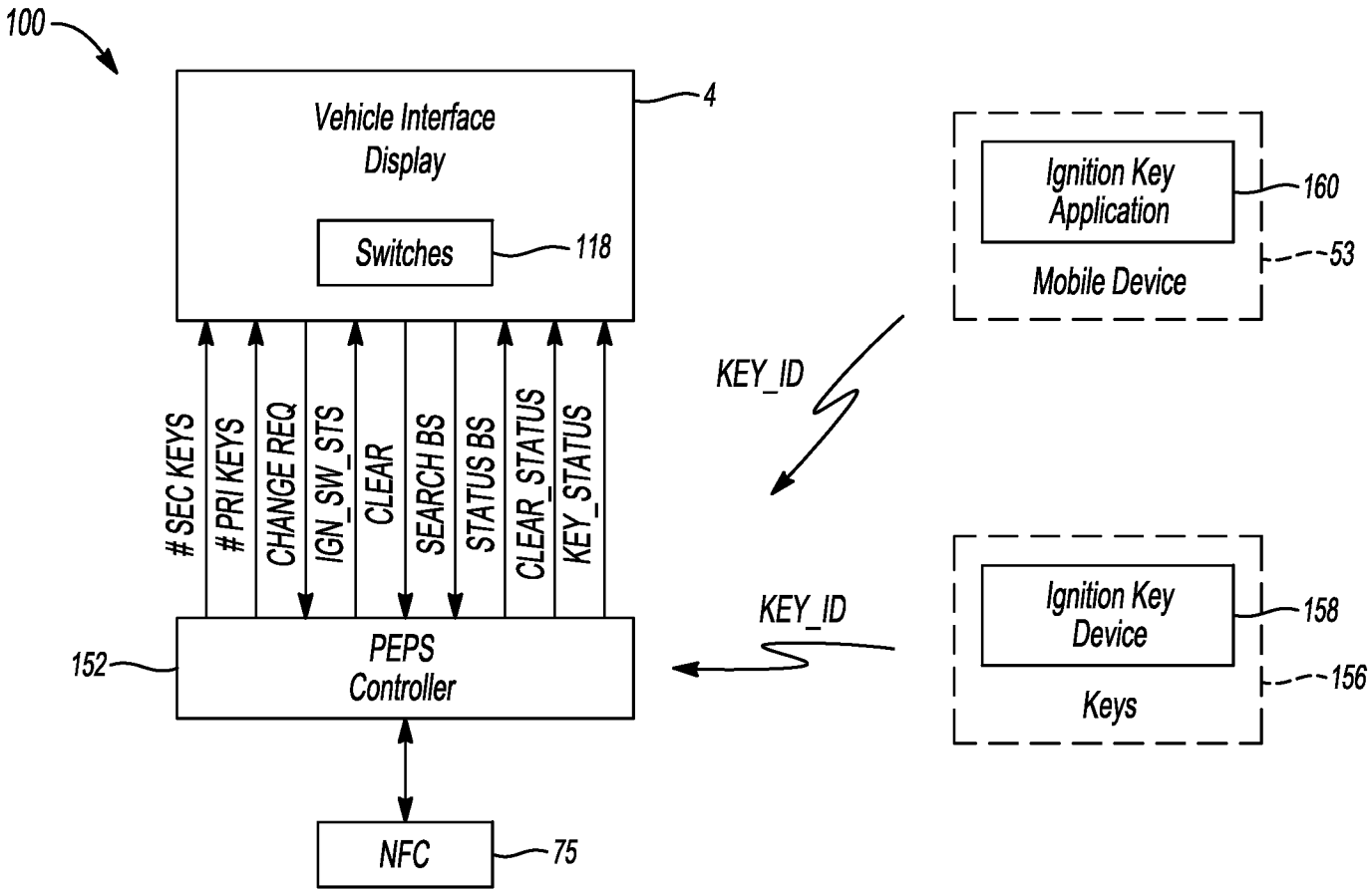
FIG. 2B depicts a system for programming the mobile device key fob for the vehicle to establish primary and secondary drivers in accordance with another embodiment of the present disclosure.

Referring now to FIG. 2B, a system 100 for programming the mobile device 53 as a key for a vehicle in accordance to one embodiment of the present disclosure is shown. The system 100 includes the vehicle interface display 4, a passive entry, passive start (PEPS) controller 152, and a slot (e.g., a NFC transceiver 75B, USB connection 23, and/or a combination thereof). The system 100 may execute the key fob management application on one or more hardware components in communication with the VCS 1. The PEPS controller 152 may be used in place of the PATS controller 116 as illustrated in FIG. 2A. While FIG. 2B generally illustrates that the PEPS controller 152 is positioned external to the vehicle interface display 4, other such implementations may include positioning the PEPS controller 152 within the vehicle interface display 4 or within any other such controller in communication with the VCS 1. The particular placement of the PEPS controller 152 may vary based on the desired criteria of a particular implementation.

In general, the PEPS function is a keyless access and start system. The driver may own two or more keys 156 that may be in the form of an electronic transmission device (e.g., a key fob). With the PEPS implementation, the user is not required to use a mechanical key blade to open the door of the vehicle or to start the vehicle. Such keys 156 may each include a mechanical key to ensure that the driver can access and start the vehicle in the event the keys 156 and/or mobile device 53 configured as a key fob exhibit low battery power. For example, if the mobile device 53 configured as a key fob is experiencing low battery power, the vehicle transceiver (NFC 75) may provide harvested energy to the mobile device transceiver to receive the vehicle security codes stored at the mobile device 53.

The keys 156 or mobile device 53 each include an ignition key device 158 or application 160 embedded within for communicating with the PEPS controller 152. The transponder of the ignition key device 158 and/or ignition key fob application 160 may be adapted to send the key number and encrypted data on the signal KEY_ID as an RF signal to the PEPS controller 152. To gain access or entry into the vehicle with the keys 156 or mobile device 53 in the PEPS implementation, the driver may need to wake up the PEPS controller 152 to establish bi-directional communication between the keys 156 or mobile device 53 and the PEPS controller 152. In one example, such a wake up may occur by requiring the driver to touch and/or pull the door handle of the vehicle. In response to the door handle being toggled or touched, the PEPS controller 152 may wake up and transmit wireless signals to the keys 156 or mobile device 53. In another example, the NFC transceiver 75A may be positioned at the vehicle door allowing a driver to bring the mobile phone key fob having an NFC transceiver (not shown) close enough (e.g., tapping) to allow the vehicle security codes to be transmitted to the VCS 1 via the transceiver 75A. The PEPS controller 152 and the keys 56 or mobile device 53 may undergo a series of communications back and forth to each other (e.g., handshaking) for vehicle access authentication purposes. The PEPS controller 152 may unlock the doors in response to a successful completion of the handshaking process. Once the driver is in the vehicle, the driver may simply press a button positioned on an instrument panel to start the vehicle.

Prior to starting the vehicle, the mobile device key fob serial number and the encrypted data are compared to known mobile numbers (e.g., media access control (MAC) addresses, telephone number, unique user identification) and/or encrypted data in a PEPS look up table in a manner similar to that described in connection with FIG. 2A. The manufacturing code is also checked to ensure the mobile device is used for a particular manufacturer of the vehicle. The PEPS LUT may be similar to the PATS LUT as shown in Table 1 and Table 2. As noted above, additional operations are performed as exhibited with the handshaking exercise in addition to matching the data received on the signal KEY_ID with the data in the LUT (e.g., key serial number and encryption data) to ensure that the user is properly authorized to enter the vehicle and to start the vehicle with the PEPS implementation. As noted above in connection with FIG. 2A, all of the mobile devices are generally assigned a primary key status when configured as the mobile device key fob. Such a condition may be reflected under the 'TYPE' heading as shown in Table 1 and Table 2. The status of the mobile device 53 may change from primary to secondary in response to the user programming a particular mobile device via the vehicle interface display 4. As further noted above, the PEPS controller 152 ascertains the key status (or driver status) of the mobile device 53 (e.g., whether primary or secondary) by decoding the mobile device number and/or encrypted data received on the signal KEY_ID and looking up the corresponding mobile device type (e.g., primary or secondary) under the 'TYPE' heading of the LUT. The PEPS controller 152 is configured to transmit the signal KEY_STATUS on the multiplexed bus to the vehicle interface display 4. The PEPS controller 152 and/or the vehicle interface display 4 may transmit the signal KEY_STATUS to any controller or module in the vehicle so that the functionality or operation performed by a particular controller (or module) may be selectively controlled based on the driver status.

The PEPS controller 152 may also transmit the signal IGN_SW_STS to the cluster 112. The PEPS controller 152 determines that the key ignition status is in the run position in response to the driver toggling the brake pedal and depressing the start switch. The driver may designate (or program) a particular mobile device 53 as a mobile device key fob. In such a case, the vehicle interface display 4 may prompt the driver to place the mobile device 53 on the slot (e.g., NFC transceiver 75) to program that particular mobile device so that the driver knows which mobile device is being programmed as a key fob. Such a condition takes into account that the driver may have two or more mobile devices in the vehicle while programming a mobile device as a key fob. The vehicle interface display 4 may send a command signal SEARCH_BS to the PEPS controller 152 to determine whether the user placed the mobile device 53 in the slot (e.g., NFC transceiver 75) for programming. It is generally contemplated that a mobile device used to first gain access to the vehicle or to authenticate starting the vehicle may not be necessarily the mobile device 53 that is placed on the slot (e.g., NFC transceiver 75). For example, another or additional mobile device (e.g. mobile device 53 not used to gain entry into the vehicle or start the vehicle) may be placed on the slot for programming. In such an example, the additional mobile device may not be able to transmit the signal KEY_ID prior to programming to the PEPS controller 152 while in the slot.

In another embodiment, the key 156 must be present when programming a mobile device as a mobile device key fob. For example, the key 156 must be in communication with the vehicle before allowing the execution of the key fob management application. In another example, the key fob management application may require a security PIN before allowing a mobile phone to be programmed as a mobile phone key fob by the mobile device key fob management system 100.

The PEPS controller 152 transmits a signal STATUS_BS to the vehicle interface display 4. The signal STATUS_BS generally corresponds to whether the user has placed the mobile device that is to be programmed as a key fob on the NFC transceiver 75. It is generally contemplated that the NFC transceiver 75 may be coupled directly to the vehicle interface display 4 instead of the PEPS controller 152. The PEPS controller 152 may transmit the signals IGN_SW_STS, STATUS_BS and KEY_STATUS over the multiplexed bus to the vehicle interface display 4. The operation of placing the mobile device 53 that is desired to be programmed on the NFC transceiver 75 as a key fob is optional. Other such implementations may instead program the mobile device as a key fob by using a pairing process similar to Bluetooth, Bluetooth Low Energy, WiFi, etc.

In general, the PEPS controller 152 may update the value under the 'TYPE' heading of Table 1 and/or Table 2 for a mobile device. For example, the mobile device may be programmed from a primary to secondary key in response to the user programming the mobile device 53 as a secondary key via the vehicle interface display 4 and/or the user placing the mobile device 53 that is desired to be programmed in the slot (e.g., NFC transceiver 75).

The driver may optionally clear all mobile devices that were designated as key fob via the vehicle interface display 4. In such a case, the driver may select the corresponding menus via the vehicle interface display 4 to clear all mobile device key fobs that were programmed. The vehicle interface display 4 transmits the signal CLEAR to control the PEPS controller 152 to clear (or change) the programmed mobile device key fobs. The PEPS controller 152 may transmit the signal CLEAR_STATUS to the vehicle interface display 4 to notify the vehicle interface display 4 that the programmed mobile device key fobs have been deleted for further communication with the VCS 1. The PEPS controller 152 transmits signals #PRIKEYS and #SECKEYS to the vehicle interface display 112 which are indicative of the number of primary mobile phone key fobs in the LUT and the number of secondary mobile phone key fobs in the LUT, respectively. The PEPS controller 152 transmits the signals #PRIKEYS and #SECKEYS in response to control signals (not shown) by the vehicle interface display 4. It is generally contemplated that the signals KEY_STATUS, #PRIKEYS, and #SECKEYS (as well as the signal CLEAR_STATUS) may be transmitted as one or more messages over the multiplexed bus to the vehicle interface display 4. For example, the data on the signals KEY_STATUS, #PRIKEYS, #SECKEYS, and CLEAR_STATUS may be transmitted as hexadecimal based data within a single message over the multiplexed data bus. Likewise, the vehicle interface display 4 may transmit the data on the signal CHANGE_REQ and CLEAR as hexadecimal based data within a single message over the multiplexed data bus.

Figure 2C:
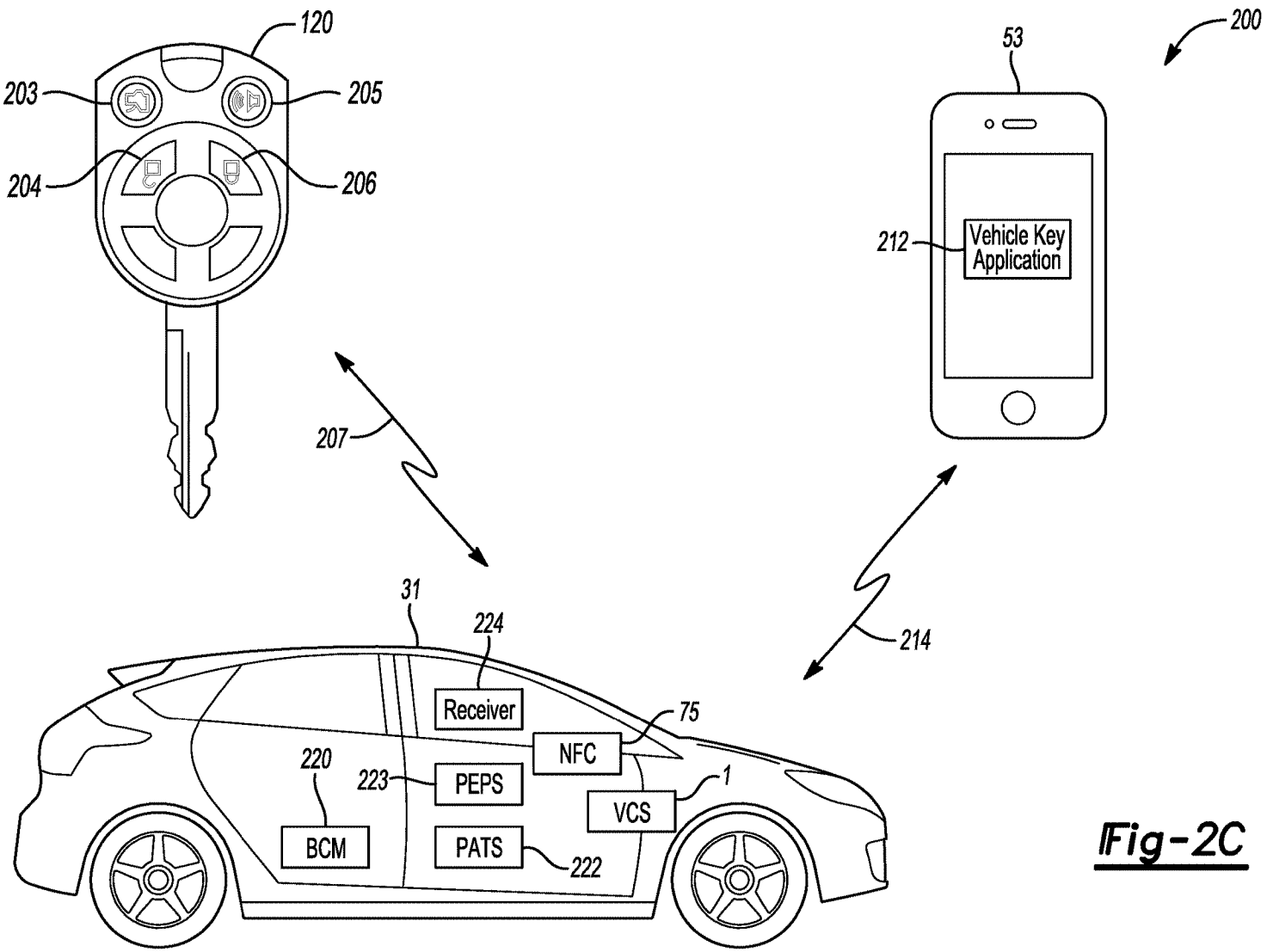
FIG. 2C is an illustrative example of the key fob management application with the vehicle key communicating with the VCS to enable programming of the mobile device with the vehicle security codes.

FIG. 2C is an illustrative example of the key fob management application requiring the vehicle key 120 to communicate with the VCS 1 to enable programming of the mobile device 53 with the vehicle security codes. The system 200 includes the vehicle key 120, the mobile device 53, and the vehicle computing system 1 enabling one or more processors to program the mobile device with the key security codes. The mobile device 53 may be programmed as a vehicle key at the VCS 1 via the key fob management application. The key fob management application requires that the vehicle key 120 communicates with the VCS 1 before transmitting security codes to the mobile device 53.

For example, the key fob management application may receive a request to program a mobile device as a key fob via the user interface screen 4. The key fob management system may detect whether the vehicle key 120 is in communication with the VCS 1 before initiating the programming of one or more mobile devices as key fobs for the vehicle. If a mobile device is in communication with the VCS 1 while a request to program a second mobile device is received, the key fob management application may transmit a message requesting the vehicle key 120 be present. If the vehicle key 120 is not present (or in communication with the VCS 1), the key fob management application may terminate the mobile device key fob programming request.

The vehicle key 120 may include at least an integrated circuit configured to transmit one or more functions to the VCS 1. The one or more functions transmitted to the VCS 1 may include, but are not limited to, commanding a vehicle 31 to unlock 204 the vehicle doors, to lock 206 the vehicle doors, to open the trunk 203, and/or to sound a vehicle alarm 205. A combination of, and/or sequential selection of, the commanding vehicle function inputs on the vehicle key may allow for additional functions. For example, if a user presses the unlock vehicle door input 204 on the key, the driver door will unlock. If the user presses the unlock door input 204 twice, all the doors on the vehicle will unlock. Another example of a user combining the key fob inputs to achieve additional commanding vehicle functions includes, but is not limited to, pressing the lock doors input 206 twice within a predetermined amount of time to hear an audio verification (e.g., horn honk) that the doors on the vehicle 31 are locked.

The vehicle key 120 may include an ignition key device (not shown) embedded therein for communicating with the VCS 1. The ignition key device comprises a transponder. The transponder includes an integrated circuit and an antenna. The transponder is adapted to transmit a signal in the form of a radio frequency (RF) signal to a (PATS) controller 222 with the use of a signal receiver 224 in communication with the VCS 1. The PATS controller may communicate with the VCS 1 and/or body control module (BCM) via a multiplexed data link communication bus (or multiplexed bus). The multiplexed bus may be implemented as a High/Medium Speed Controller Area Network (CAN) bus, a Local Interconnect Network (LIN), or any such suitable data link communication bus generally situated to facilitate data transfer between controllers (or modules) in the vehicle 31.

The signal 207 being transmitted from the key transponder generally comprises an RF signal with data that correspond to a manufacturer code, a corresponding key serial number, and encrypted information. The key serial number and the encrypted information are used to authorize the VCS 1 to start the vehicle in the event the encrypted information corresponds to predetermined encrypted information stored in a LUT of the PATS 222 controller. The PATS 222 controller may use the key number and/or the encrypted information transmitted from the key fob security code signal 207 to determine if the key is a primary key or a secondary key.

The vehicle key 120 may also be configured to transmit to a PEPS controller 223 allowing for wireless transmission of vehicle control functions without pressing any buttons on the key fob. For example, the PEPS may become initialized by requiring the driver to touch and/or pull the door handle of the vehicle. In response to the door handle being toggled or touched, the PEPS controller 223 may wake up and transmit RF based signals to the key 120. The PEPS controller 223 and the key 120 may undergo a series of communication signals 207 back and forth to each other (e.g., handshaking) for vehicle access authentication purposes. The PEPS controller 223 may unlock the doors in response to a successful completion of the handshaking process. Once the driver is in the vehicle 31, the driver may simply press a button positioned on an instrument panel to start the vehicle 31.

In one embodiment, the vehicle key 120 may be required to be in communication with the VCS 1 before transmission 214 of the vehicle security codes to one or more mobile devices 53. For example, the user may request programming of a mobile device to be configured as a key fob via the key fob management application. The key fob management application may initiate the VCS 1 to begin the transmission of the vehicle security codes to the mobile device 53. The VCS 1 may transmit 214 the security codes to a mobile device using a transponder (e.g., transceiver) that may include wireless and/or wired technology. The VCS 1 may include one or more processors communicating with the transponder to wirelessly communicate vehicle security codes. The transmission of the security codes from the VCS 1 may be accomplished using wireless communication including, but not limited to, Bluetooth, WiFi, and/or NFC.

The mobile device 53 may receive the security codes from the VCS 1 when the vehicle key 120 is in communication with the system 1. In response to receiving the vehicle security codes, the mobile device 53 may configure a software application 212 to perform one or more vehicle controls using the mobile device. The vehicle key application 212 being executed on hardware of the mobile device 53 may be an application that was developed and/or associated with the vehicle manufacturer.

For example, a customer may receive one key 120 associated with the vehicle from a dealership during the vehicle purchase. The customer may then download an application to a mobile device 53 and use the VCS 1, while the key 120 is present, to transmit the vehicle security codes to the mobile device 53. Once the vehicle security codes have been transmitted to the mobile device 53, the customer may then use that mobile device 53 as the vehicle key. This may allow the vehicle manufacturer to eliminate distribution of multiple keys for each vehicle. The mobile device key fob system 100 and application may also allow the vehicle operator to make additional copies of a vehicle key on one or more mobile devices while eliminating the need carry around the actual vehicle key 120 to operate the vehicle 31.

In another example, the mobile device may receive vehicle security codes and a predefined user identification (e.g., numerical password, picture password, etc.) to configure the software application 212. The mobile device may require the user to enter the predefined user identification code via the software application 212 before transmitting one or more vehicle functions to the vehicle. For example, the software application 212 may require the numerical password received and defined at the VCS before allowing the command message to be sent to the VCS 1. In response to the numerical password, the software application 212 may begin to transmit one or more vehicle functions to the vehicle.

In one embodiment, the one or more security codes may be communicated from the VCS 1 to the mobile device 53 using wireless technology 214 including, but not limited to, Bluetooth. In this embodiment, a vehicle customer may initiate the VCS using the vehicle key 120 to commence the transfer of the one or more security codes to the mobile device 53. The mobile device 53 may be located in the vehicle cabin and may be in communication with the VCS 1. The process may require the mobile device 53 to be paired with the VCS 1 before the transmission of the one or more security codes are wirelessly transmitted. The process of requiring the vehicle key 120 to initiate the VCS 1 to transfer the one or more security codes requires the mobile device 53 to be in close proximity of the vehicle.

The customer may request the transfer of the one or more vehicle security codes to the mobile device using the VCS 1 interface/display 4. The process may require the mobile device 53 to be placed in a specific area in the vehicle cabin before the transfer of security codes begins. For example, the mobile device 53 may be configured with an NFC transceiver (not shown) and may have to be placed in a vehicle NFC transceiver slot 75B before the transmission of codes. After the transmission of the one or more security codes are sent to the mobile device via the NFC transceiver 75B, the customer may remove the vehicle key 120 from the vehicle and use the mobile device 53 to initiate the VCS 1. The mobile device may configure the vehicle key application 212 with the received vehicle security codes. The mobile device 53 communication to initiate the VCS 1 may include, but is not limited to, wireless communication with one or more vehicle controls, features and/or functions. The one or more vehicle controls include, but are not limited to, keyless control of starting the vehicle, unlocking/locking doors, and/or opening the trunk with the mobile device 53.

In another embodiment, the mobile device vehicle key application 212 may allow control of vehicle functions once the PEPS controller 223 has initialized by requiring the driver to touch and/or pull the door handle of the vehicle. In response to the door handle being toggled or touched, the PEPS controller 223 may wake up and transmit signals to the mobile device 53. The PEPS controller 223 and the mobile device 53 may undergo a series of communications 214 back and forth to each other (e.g., handshaking) for vehicle access authentication purposes. The PEPS controller 223 may unlock the doors in response to a successful completion of the handshaking process. Once the driver is in the vehicle, the driver may simply press a button positioned on an instrument panel to start the vehicle. The communication 214 between the one or more controllers at the vehicle 31 and mobile device 53 may be accomplished using wireless communication including, but not limited to, Bluetooth, WiFi, and/or near field communication.

Another example of the mobile device key fob and vehicle handshake may be done using Bluetooth Low Energy technology. Bluetooth Low Energy allows low-power and low-latency wireless communication between devices within a short range (up to 50 meters/160 feet). This facilitates recognition of the mobile device key fob by the VCS with minimal battery power as the user approaches the vehicle.

The mobile device key application 212 may also control vehicle functions with the use of one or more mobile device functions including, but not limited to, voice commands, touch screen inputs, and/or other mobile device communication functions allowing the user to request control of vehicle features that are generally configured to communicate with the VCS 1. For example, if a user is approaching the vehicle, the PEPS may be initialized by a short range communication signal transmitted from the mobile device 53. The mobile device 53 may transmit a signal allowing for the handshaking authorization process to begin with the PEPS controller 223. Once the handshaking between the mobile device 53 and the PEPS 223 is complete, the user may unlock the doors using vocal commands that may be received by the mobile device microphone and processed by the vehicle key application software 212 to transmit 214 the unlock request signal to the PEPS controller 223. The PEPS controller 223 may receive the request to unlock the doors and transmit the command to unlock the doors to the BCM 220.

Figure 3:
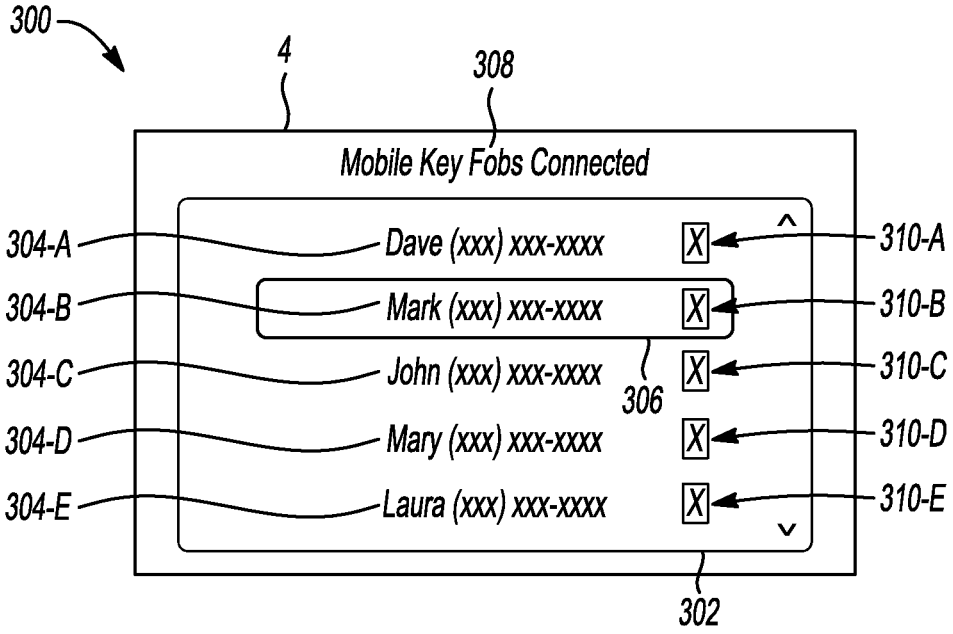
FIG. 3 illustrates an exemplary mobile device key fob system presenting management mode options at a display.

FIG. 3 illustrates an exemplary mobile device key fob system presenting management mode options at the display 4. The user interface 300 may be presented at the touch-screen display 4 and may include a list control 302 configured to display selectable list entries 304-A through 304-E (collectively 304) of the management mode application for one or more mobile devices programmed as a key fob for the vehicle. The management mode may scroll through each of the selectable list entries 304 while providing a clear (e.g., delete) option 310-A through 310-E (collectively 310) of each mobile device configured to communicate with the VCS 1.

For example, in response to the key fob management application being enabled, the VCS 1 may present the selectable list entries 304 at the display 4. The management mode may highlight each mobile device configured as a key fob 304 while providing an option to delete the mobile device as a key fob as entry 310. In another example, the VCS 1 may transmit the key fob management messages to a connected handheld device 53 so that the selectable list entries 304 may be displayed at the device 53.

The key fob management application may be available on the handheld device 53 to receive user input for managing one or more mobile devices configured as a key fob. The mobile device 53 may communicate to the VCS 1 via a wired and/or wireless connection. For example, the user interface 300 and the other user interfaces discussed herein may be displayed elsewhere, such as by way of a connected application executed by the VCS 1 via a paired connection with the mobile device 53. The user interface 300 may also include a title label 308 to indicate to the user that the user interface 300 is utilizing the connected application of the VCS 1.

As illustrated, the selectable list 302 of the key fob management application includes an entry 304-A for Dave's mobile device configured as a key fob for the vehicle, an entry 304-B for Mark's mobile device configured as a key fob, and an entry 304-C for John's smart watch configured as a key fob. The list control 302 may operate as a menu, such that a user of the user interface 300 may scroll through list entries of the list control 302 (e.g., using up and down arrow buttons and a select button to invoke the selected menu item 306). In some cases, the list control 302 may be displayed on a user interface screen of the mobile device 53, such that the user may be able to touch the list control 302 to select and delete a configured mobile device key fob. For example, when the entry 304-B for Mark's mobile device is selected, the VCS 1 may provide an option to contact Mark, change Mark's key fob from a primary to a secondary driver key fob, or to delete the entry.

The key fob application may respond to a selected entry 304 and provide one or more settings related to the selected entry 304. For example, when the entry 304-B for Mark's mobile device is selected 306, the VCS may provide one or more key fob settings for Mark's mobile device configured as a key fob.

The list control 302 may include additional entries. For example, an entry 304-D for Mary's mobile device configured as a key for the vehicle. As another example, the "Laura mobile device" entry 304-E, when invoked, may be configured to call, delete, change a user PIN, delete as a key fob, and/or a combination thereof.

In another embodiment, the key fob management application may allow the configuration of a user PIN associated with the mobile device key fob. The key fob management application may require the user PIN to be selected during the configuration/programming process of the mobile device as a key fob. For example, the key fob management application may receive a unique identifier, user identification, and/or combination thereof to validate a user of the mobile device key fob.

In one example, the mobile device 53 may be in communication with the VCS 1 to transmit an unlock request via the NFC transceiver 75A at the vehicle door. In response to the unlock request, the key fob management application may identify and approve the mobile device key fob so that the VCS 1 may transmit an unlock request for the vehicle door. The user may request to start the powertrain of the vehicle using the vehicle security codes via the mobile device key fob. The VCS may request the driver to enter the user PIN associated with the mobile device key fob via the user display 4. The user PIN provides additional security to prevent an unauthorized mobile device key fob user from enabling the vehicle for a drive away event. In another example, the user PIN may be entered at a keypad located at the vehicle door so that the user may gain access to the vehicle and enable the powertrain based on the mobile phone key fob in combination with the user PIN. The user PIN may include, but is not limited, biometrics, picture password(s), and/or a predefined numerical password(s).

In another example, the list entries 304 may include the user's name, mobile identification, user PIN, and/or a combination thereof. The mobile device key fob application may have a unique identifier associated with the user (e.g., user PIN) and/or the mobile device (e.g., a MAC address) to provide additional security when allowing one or more mobile devices to communicate with the VCS. In one example, the vehicle security codes may include a rolling security code to provide additional security for the wireless communication between the mobile device and the VCS by preventing an eavesdropper recording and subsequent replay attack.

Figure 4:
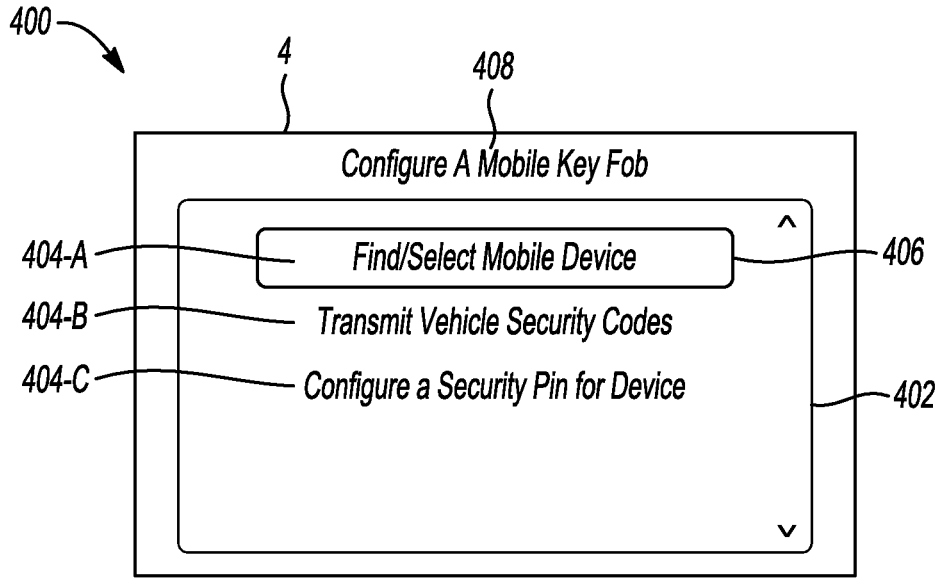
FIG. 4 illustrates an exemplary user interface of the mobile device key fob system from which settings for the configuration of the mobile device are displayed via the key fob management application.

FIG. 4 illustrates an exemplary user interface of the mobile device key fob system from which settings for the configuration of the mobile device are displayed via the key fob management application. As with the user interface 300, the user interface 400 may also be presented at a display via the VCS 1. The user interface 400 may include a list control 402 configured to display a selectable list of entries, where each entry is associated with a corresponding application command 404-A through 404-C (collectively 404). Each of the commands 404 may indicate a feature available for use by the VCS 1. The user interface 400 may also include a title label 408 to indicate to the user that the user interface 400 is providing configuration of a mobile key fob for the mobile device key fob system.

With respect to the commands 404 of the list control 402, as one example, the list control 402 may include a command 404-A that, when invoked, is configured to find/select a mobile device for configuration. As another example, the list control 402 may include a command 404-B that, when invoked, is configured to transmit vehicle security codes to the selected mobile device. As a further example, the list control 402 may include a command 404-C that, when invoked, is configured to configure a user security code for the mobile device key fob.

The VCS 1 may present a menu or control for configuration of mobile key fob settings 408 for output at the vehicle display 4 via a user invoked selection. A user may be able to find/select a mobile device in proximity/connected to the transceiver of the VCS 1. For example, the VCS may begin to search for a mobile device within a short range wireless proximity to the vehicle transceiver. The find/select mobile device menu option may output for display the one or more mobile devices communicating with the VCS via the transceiver. The user may select the desired mobile device for configuration as a key fob.

As with the list control 302, the list control 402 may also operate as a menu, such that a user of the user interface 400 may scroll through list entries of the list control 402 (using up and down arrow buttons and a select button to invoke the selected menu item 406). Upon touch or button selection of one of the commands 404 via the user interface, the VCS 1 may be configured to perform the selected action.

Figure 5:
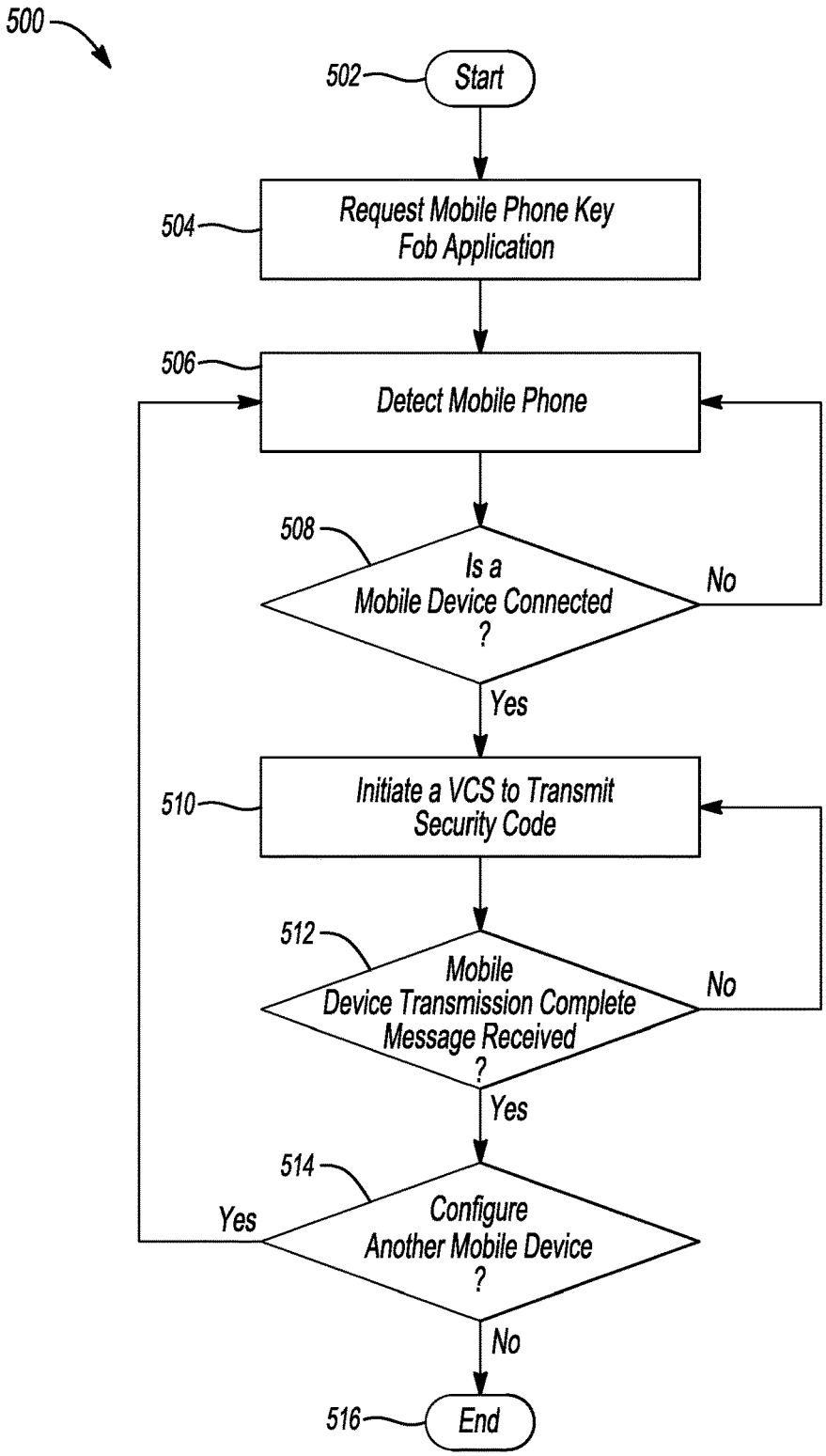
FIG. 5 is a flow chart illustrating an example method of a vehicle computing system receiving instructions from the mobile device key fob system.

FIG. 5 is a flow chart illustrating an example method 500 of a vehicle computing system receiving instructions from a mobile device key fob system. The mobile device key fob system communicating with the PEPS and/or VCS may be implemented through a computer algorithm, machine executable code, non-transitory computer-readable medium, or software instructions programmed into a suitable programmable logic device(s) of the vehicle, such as the VCS, the entertainment module, other controller in the vehicle, or a combination thereof. Although the various steps shown in the mobile device key fob flowchart diagram 500 appear to occur in a chronological sequence, at least some of the steps may occur in a different order, and some steps may be performed concurrently or not at all.

In operation 502, the vehicle computing system may be initialized based on a key and/or key fob configured to communicate with the system. The user may request the configuration of one or more mobile devices via the mobile phone key fob application. The mobile phone key fob application may be executed at one or more processors in communication with the system in operation 504. In one example, the user may select a mobile device key fob application at the user interface to begin the configuration of a mobile device as a key fob.

In operation 506, the system may detect a mobile device in proximity to the vehicle transceiver. The system may undergo a series of communications back and forth to identify the one or more mobile devices available for communication with the VCS. If a mobile device is found, the system may determine if the mobile device is in communication with the VCS in operation 508. For example, a mobile device may be paired with the VCS. In one example, the detected mobile device may be in communication with the vehicle NFC transceiver. In another example, the detected mobile device may be connected to communicate with the VCS via a wired connection (e.g., USB connection). The system may output for display the one or more connected mobile devices at the user interface. The user may select the mobile device for configuration as a key fob for the vehicle.

In operation 510, the system may initiate the one or more vehicle security codes to be transferred to the mobile device. In one example, the system may require a security PIN to be associated with the mobile device after the programming of the one or more vehicle security codes is complete. The transmission of the one or more vehicle security codes to the mobile device may be communicated using wireless technology including, but not limited to, WiFi, NFC, Bluetooth, and Bluetooth Low Energy.

In operation 512, the system may monitor when the programming of the mobile device is complete. The system may receive a programming complete message if the mobile device received the vehicle security codes and completed the configuration of the mobile device key fob application. The system may continue to transmit the vehicle security codes until a completion message is received from the mobile device. In one example, if an error is detected during the programming of the mobile device, the VCS may abort the transmission and set an error flag.

In operation 514, in response to a programming completion message from the mobile device, the system may allow for another mobile device in communication with the VCS to be configured as a key fob. If the user has completed programming a mobile device as the key fob, the user may exit the key fob management application in operation 516.

In response to the system transmitting the security codes associated with the vehicle to the mobile device, the VCS and/or PEPS controller may allow control of the received vehicle function requests from the mobile device without the use of the key and/or key fob. The mobile device may transmit commands to the PEPS and/or VCS to initiate keyless entry and/or keyless engine start features. The PEPS and/or VCS controller may receive the control commands from the device and allow execution of the commanded vehicle function and/or feature. The PEPS and/or VCS controller(s) may transmit the vehicle control command to the appropriate controller or subsystem in the vehicle. The mobile device may terminate communication with the vehicle if the user decides to terminate the connection. For example, terminating communication between the mobile device and the VCS and/or PEPS may be initiated by the user exiting the vehicle and the increasing distance of the mobile device relative to the PEPS as the user walks away from the vehicle. If the mobile device is left in the vehicle after a key-off event, the system may provide one or more notices to alert the user that the mobile device was left in the vehicle. For example, after a key-off event, a driver closes the door, and/or a seat sensor indicating no driver, the system may transmit a message to chirp a vehicle horn.

In another example, the mobile device key fob may be in close proximity to enter/start the vehicle, however, the mobile device is left outside the vehicle and the system may output a warning message to the user indicating that the mobile device is no longer in communication with the system. The system may measure signal strength and/or determine when the mobile device key fob is no longer in communication during a key-on/vehicle drive state.

Figure 6:
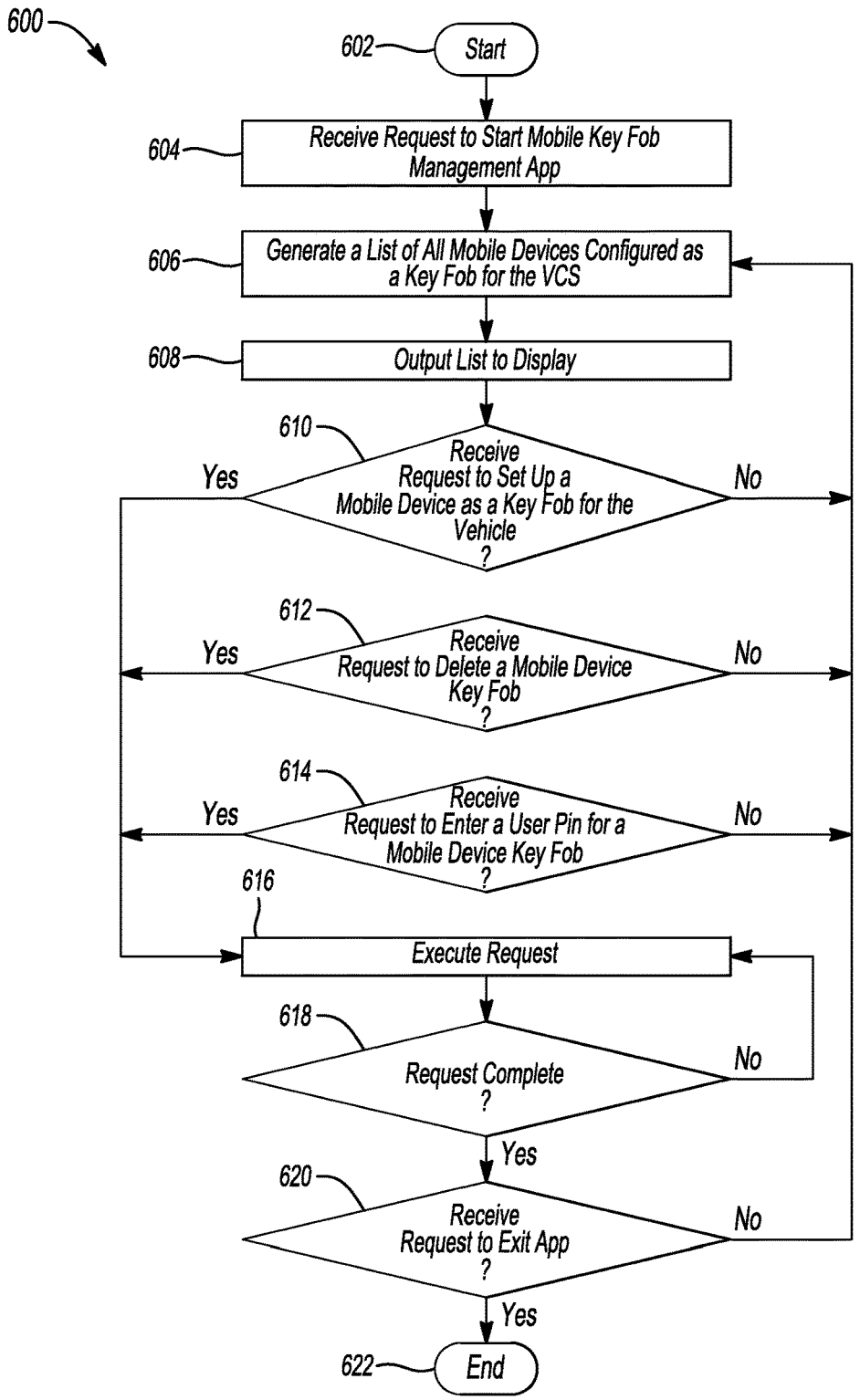
FIG. 6 is a flow chart illustrating an example method of managing the mobile device key fob system.

FIG. 6 is a flow chart illustrating an example method 600 of managing a mobile device key fob system. The vehicle computing system may be initialized based on a key, key fob, and/or mobile device key fob configured to communicate with the system in operation 602. The mobile device key fob application may be enabled based on a request at the user interface in operation 604.

In operation 606, the mobile device key fob application may generate a list of the one or more mobile devices configured as a key fob for the vehicle. The application may output the list to a user display in operation 608. For example, as shown in FIG. 3, the list may include the one or more mobile devices configured as a key fob for the system.

The mobile device key fob application may provide the list of the one or more mobile devices configured as a key fob for the vehicle with one or more configuration settings. The one or more configuration settings may include options for adding, deleting, adding a user PIN, and/or a combination thereof. For example, the mobile device key fob application may receive a request to set up a mobile device as a key for the vehicle in operation 610. The mobile device key fob application may receive a request to delete a mobile device key fob in operation 612. The mobile device key fob application may receive a request to enter a user PIN for a mobile device key fob in operation 614.

In operation 616, the application may execute the one or more configuration settings requested by the user. The application may determine if the request is complete in operation 618. If the execution request for the one or more configuration settings is not complete, the application may continue the execution.

In operation 620, in response to completion of a configuration setting request, the application may receive a request to exit the application. If the user is finished with managing the mobile device key fob system, the user may exit the key fob management application in operation 622.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. A system comprising:

one or more vehicle processors programmed to:

wirelessly transmit vehicle key security codes to a first device comprising a processor, the first device selected via a permanently installed vehicle-mounted user interface for programming as a new vehicle key; and delete a second wireless device comprising a processor as an existing vehicle key in response to selection of the second device from programmed key devices displayed via the vehicle-mounted user interface.

2. The system of claim 1 wherein the one or more vehicle processors are further programmed to delete the second wireless device by clearing or modifying security codes associated with the second device in at least one vehicle program memory.

3. The system of claim 1 wherein the one or more vehicle processors are further programmed to delete the second wireless device by wirelessly transmitting a signal to the second wireless device.

4. The system of claim 1, wherein the one or more vehicle processors are further configured to search for a signal from a vehicle key transmitter to enable the programming of the first device as the new vehicle key.

5. The system of claim 1, wherein the vehicle key security codes configure a mobile device application at the first device to implement one or more vehicle control functions using the security codes.

6. The system of claim 5, wherein the one or more vehicle processors are further programmed to wirelessly receive commands for implementing one or more vehicle control functions via the first device using the vehicle key security codes for the vehicle without a manufacturer vehicle key present.

7. The system of claim 1, wherein the one or more vehicle processors are further programmed to prompt a user to assign a security PIN for the first device.

8. The system of claim 7, wherein the security PIN is at least one of biometrics, a picture password, and a predefined numerical password.

9. The system of claim 8, wherein the predefined numerical password may be entered at a vehicle-mounted door key pad.

10. The system of claim 1 wherein the one or more vehicle processors are further programmed to:

initialize a predefined timer for the vehicle key security codes; and enable the first device to implement one or more vehicle control functions using the vehicle key security codes before the predefined timer expires.

11. The system of claim 1, wherein the first and second devices are each a smartphone, a tablet, or a personal computer.

12. The system of claim 1, wherein the one or more vehicle processors are further programmed to:

configure the first device to be identifiable as either a primary key or a secondary key, wherein the primary key provides greater control over vehicle functionality than the secondary key; and transmit a signal indicative of the first device being one of the primary key or the secondary key.

13. A non-transitory computer readable medium comprising instructions configured to cause at least one processor coupled to a transceiver to:

receive a request via the transceiver for establishing communication between the at least one processor and a vehicle processor;

receive vehicle key security codes and a predefined user identification from the vehicle processor based on the established communication such that the at least one processor is configured to command one or more vehicle functions without the presence of a vehicle key fob; and in response to the predefined user identification entered at a user interface, transmit the one or more vehicle functions to the vehicle processor.

14. The computer readable medium of claim 13, further comprising instructions configured to receive a signal indicative of assigning the at least one processor as a primary key or a secondary key, wherein the primary key provides greater control over vehicle functionality than the secondary key.

15. The computer readable medium of claim 13, wherein the transceiver is configured to receive harvested energy from a vehicle transceiver coupled to the vehicle processor so that the at least one processor coupled to the transceiver may transmit at least one of the vehicle key security codes and the user identification.

16. The computer readable medium of claim 13, wherein the predefined user identification is at least one of a picture password and a numerical password.

17. A vehicle computing system comprising:

a processor communicating with a transceiver and a user interface and programmed to:

transmit vehicle security codes and a predefined user identification via the transceiver to configure a mobile device comprising a processor as a key fob in response to receiving a key fob program request via the user interface, the mobile device selected via the user interface from mobile devices detected by the processor and transceiver.

18. The vehicle computing system of claim 17, wherein the processor is additionally programmed to output at least a portion of a list of mobile device key fobs programmed to communicate the one or more vehicle control functions and enable a user to delete a mobile device from the list.

19. The vehicle computing system of claim 17, wherein the predefined user identification is at least one of a unique identifier associated with the user and a media access control address associated with selected mobile device.

20. The vehicle computing system of claim 17, wherein the transceiver is configured to provide harvested energy to a mobile device transceiver so that the at least one processor may receive vehicle security codes stored at a configured mobile device as the key fob.

* * * * *